US006343774B1

(12) United States Patent
Thomas et al.

(10) Patent No.: US 6,343,774 B1
(45) Date of Patent: Feb. 5, 2002

(54) BODY WASHER DEVICE

(76) Inventors: Deborah L. Thomas; Thomas W. Thomas, both of 8800 Ford Ave., Kansas City, MO (US) 64138

( * ) Notice: Subject to any disclaimer, the term of this patent is extended or adjusted under 35 U.S.C. 154(b) by 0 days.

(21) Appl. No.: 09/502,290

(22) Filed: Feb. 11, 2000

(51) Int. Cl.[7] ..... F16B 47/00; A47K 7/02

(52) U.S. Cl. ..... 248/206.3; 4/606; 15/222; 15/104.92; 15/21.1; 15/160

(58) Field of Search ..... 248/206.3; 4/606; 15/104.92, 21.1, 160, 222

(56) References Cited

U.S. PATENT DOCUMENTS 3,155,238 A * 11/1964 Bennett ..... 211/60
3,577,985 A * 5/1971 Guffin ..... 128/57
3,750,226 A * 8/1973 Morgan ..... 15/187
4,417,362 A * 11/1983 Walker ..... 4/606
5,072,480 A * 12/1991 Peters et al. ..... 15/114
D389,278 S * 1/1998 Kelly, Jr. ..... D28/63
5,704,903 A * 1/1998 Jahnke ..... 601/97
5,983,556 A * 11/1999 Zaloga ..... 43/57.1

* cited by examiner

*Primary Examiner*—Anita King
*Assistant Examiner*—Kimberly Wood

(57) ABSTRACT

A body washer device for cleaning the hard-to-reach areas of a person's body. The body washer device includes a plurality of body washing members which are selected from a group consisting of netting, sponges such as loofah, buffing pads, and exfoliated fabric, and also includes either a mat or an elongate member having curved ends which support the body washing members; and further includes suction cup members for attaching to a structure such as a shower wall or a bathtub floor.

5 Claims, 1 Drawing Sheet

BODY WASHER DEVICE

BACKGROUND OF THE INVENTION

1. Field of the Invention

The present invention relates to a hands-off back side washer device and more particularly pertains to a new body washer device for cleaning the hard-to-reach areas of a person's body.

2. Description of the Prior Art

The use of a hands-off back side washer device is known in the prior art. More specifically, a hands-off back side washer device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,561,869; U.S. Pat. No. 5,600,864; U.S. Pat. No. 5,277,389; U.S. Pat. No. 5,784,722; U.S. Pat. No. 5,628,083; and U.S. Pat. No. 5,560,064.

While these devices fulfill their respective, particular objectives and requirements, the aforementioned patents do not disclose a new body washer device. The inventive device includes a plurality of body washing members which are selected from a group consisting of netting, sponges such as loofah, buffing pads, and exfoliated fabric, and also includes either a mat or an elongate member having curved ends which support the body washing members; and further includes suction cup members for attaching to a structure such as a shower wall or a bathtub floor.

In these respects, the body washer device according to the present invention substantially departs from the conventional concepts and designs of the prior art, and in so doing provides an apparatus primarily developed for the purpose of cleaning the hard-to-reach areas of a person's body.

SUMMARY OF THE INVENTION

In view of the foregoing disadvantages inherent in the known types of hands-off back side washer device now present in the prior art, the present invention provides a new body washer device construction wherein the same can be utilized for cleaning the hard-to-reach areas of a person's body.

The general purpose of the present invention, which will be described subsequently in greater detail, is to provide a new body washer device which has many of the advantages of the hands-off back side washer device mentioned heretofore and many novel features that result in a new body washer device which is not anticipated, rendered obvious, suggested, or even implied by any of the prior art hands-off back side washer device, either alone or in any combination thereof.

To attain this, the present invention generally comprises a plurality of body washing members which are selected from a group consisting of netting, sponges such as loofah, buffing pads, and exfoliated fabric, and also includes either a mat or an elongate member having curved ends which support the body washing members; and further includes suction cup members for attaching to a structure such as a shower wall or a bathtub floor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new body washer device which has many of the advantages of the hands-off back side washer device mentioned heretofore and many novel features that result in a new body washer device which is not anticipated, rendered obvious, suggested, or even implied by any of the prior art hands-off back side washer device, either alone or in any combination thereof.

It is another object of the present invention to provide a new body washer device which may be easily and efficiently manufactured and marketed.

It is a further object of the present invention to provide a new body washer device which is of a durable and reliable construction.

An even further object of the present invention is to provide a new body washer device which is susceptible of a low cost of manufacture with regard to both materials and labor, and which accordingly is then susceptible of low prices of sale to the consuming public, thereby making such body washer device economically available to the buying public.

Still yet another object of the present invention is to provide a new body washer device which provides in the apparatuses and methods of the prior art some of the advantages thereof, while simultaneously overcoming some of the disadvantages normally associated therewith.

Still another object of the present invention is to provide a new body washer device for cleaning the hard-to-reach areas of a person's body.

Yet another object of the present invention is to provide a new body washer device which includes a plurality of body washing members which are selected from a group consisting of netting, sponges such as loofah, buffing pads, and exfoliated fabric, and also includes either a mat or an elongate member having curved ends which support the body washing members; and further includes suction cup members for attaching to a structure such as a shower wall or a bathtub floor.

Still yet another object of the present invention is to provide a new body washer device that is easy and convenient to mount either to a wall or to a floor in the bathtub.

Even still another object of the present invention is to provide a new body washer device that can be moved about and adjusted as desired by the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
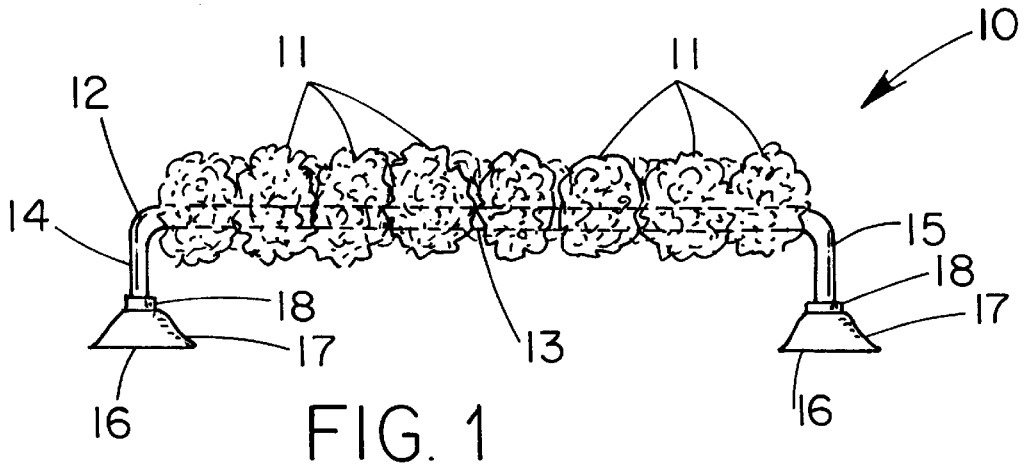
FIG. 1 is a side elevational view of a new body washer device according to the present invention.
Figure 2:
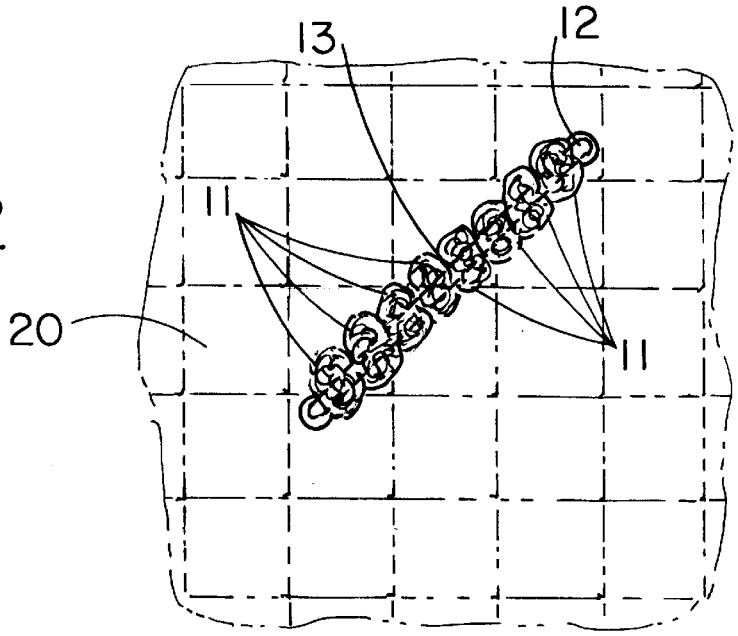
FIG. 2 is a front elevational view of the present invention being used.
Figure 3:
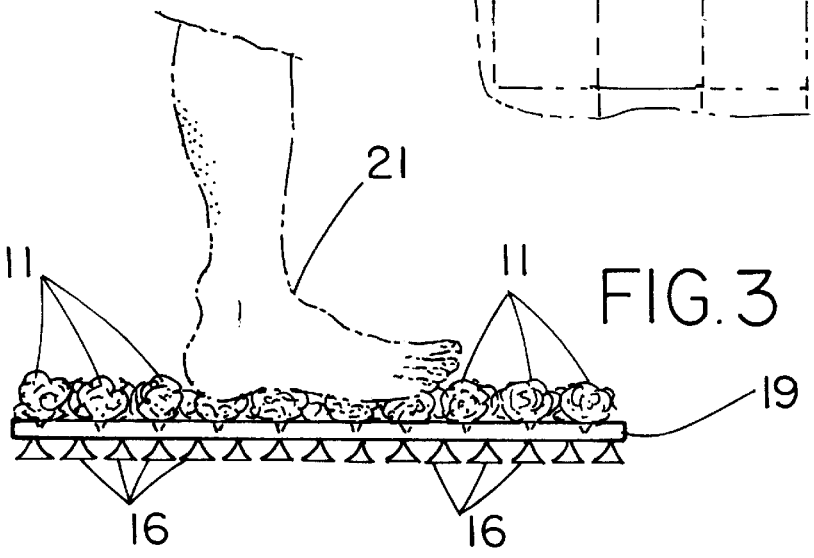
FIG. 3 is a side elevational view of the second embodiment of the present invention.

With reference now to the drawings, and in particular to FIGS. 1 through 3 thereof, a new body washer device embodying the principles and concepts of the present invention and generally designated by the reference numeral 10 will be described.

As best illustrated in FIGS. 1 through 3, the body washer device 10 generally comprises a plurality of body washing members 11 being selected from a group consisting of netting, sponges made of loofah, buffing pads, and exfoliated fabric, and further comprises a means for supporting the body washing members 11. A means for securely and detachably mounting the means for supporting the body washing members 11 to a structure includes a plurality of suction cup members 16 each having a suction cup portion 17 and a boss portion 18 integrally attached to the suction cup portion 17 with the suction cup members 16 being adapted to securely and detachably attach to a shower wall 20 and a bathtub floor.

As a first embodiment, the means for supporting the body washing members 11 includes an elongate member 12 having a main portion 13 and curved ends 14,15. The body washing members 11 are disposed along and securely and conventionally attached and mounted about the main portion 13 of the elongate member 12 with the curved ends 14,15 being angled at approximately 90 degrees to the main portion 13 of the elongate member 12. The elongate member 12 has a length of approximately 18 to 20 inches with the curved ends being securely and conventionally extended in the boss portions 18 of the suction cup members 16. The elongate member 12 is adapted to be spaced from the shower wall 20 and is adapted to be adjustably positioned upon the shower wall 20 so that a user can scrub one's back upon the body washing members 11.

As a second embodiment, the means for supporting the body washing members 11 includes a mat 19 made essentially of rubber with the body washing members 11 being securely and conventionally attached and spread about and along and upon a top side of the mat 11. The suction cup members 16 are securely attached upon a bottom side of the mat 19 and are adapted to be securely and removably attached to a floor of a bathtub for a user to stand upon and wash one's feet 21.

In use, the user positions the elongate member 12 upon the shower wall 20 so that the user can scrub one's back along the body washing members 11. The user can place soap upon the body washing members 11 and as the user rubs one's back upon the body washing members 11 soapy suds is formed which conveniently cleans the user's back without using hands as the user rubs along the body washing members 11. Also, the user can position the mat 19 upon the floor of the bathtub and stand upon the body washing members 11 and rub one's feet 21 upon the body washing members 11 to conveniently clean and wash one's feet 21.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A body washer device comprising:

a plurality of body washing members;

a means for supporting said body washing members including an elongate member having a main portion and curved ends, said body washing members being attached to said main portion, said plurality of body washing members being disposed along a length of said main portion, said main portion passing through each body washing member of said plurality of body washing members; and a means for securely and detachably mounting said means for supporting said body washing members to a structure including a plurality of suction cup members each having a suction cup portion and a boss portion integrally attached to said suction cup portion, said suction cup portion being adapted to securely and detachably attach to a shower wall and a bathtub floor, each of said suction cup members being mounted on one of said curved ends of said elongate member for securing each of said ends to a structure such that said curved ends space the main portion of said elongate member from the structure.

2. A body washer device as described in claim 1, wherein said body washing members are selected from a group consisting of netting, sponges made of loofah, buffing pads, and exfoliated fabric.

3. A body washer device as described in claim 1, wherein said curved ends are angled at approximately 90 degrees to said main portion of said elongate member.

4. A body washer device as described in claim 1, wherein said curved ends are securely extended in said boss portions of said suction cup members.

5. A body washer device comprising:

a plurality of body washing members being selected from a group consisting of netting, sponges made of loofah, buffing pads, and exfoliated fabric;

a means for supporting said body washing members; and a means for securely and detachably mounting said means for supporting said body washing members to a structure including a plurality of suction cup members each having a suction cup portion and a boss portion integrally attached to said suction cup portion, said suction cup members being adapted to securely and detachably attach to a shower wall and a bathtub floor;

wherein said means for supporting said body washing members includes an elongate member having a main portion and curved ends, said body washing members being attached to said main portion, said plurality of body washing members being disposed along a length of said main portion, said main portion passing through each body washing member of said plurality of body washing members, said curved ends being angled at approximately 90 degrees to said main portion of said elongate member, said elongate member having a length of approximately 18 to 20 inches, said curved ends being securely extended in said boss portions of said suction cup members such that said curved ends space the main portion of said elongate member from the shower wall.

* * * * *